US012643024B2

(12) United States Patent
Stucker

(10) Patent No.: US 12,643,024 B2
(45) Date of Patent: Jun. 2, 2026

(54) FOLD-UP FRAME FOR A PORTABLE BASKETBALL GAME AND PORTABLE BASKETBALL GAME WITH FOLD-UP FRAME

(71) Applicant: Pop-A-Shot Enterprise LLC, Peoria, IL (US)

(72) Inventor: Anthony John Stucker, Peoria, IL (US)

(73) Assignee: Pop-A-Shot Enterprise LLC, Peoria, IL (US)

( * ) Notice: Subject to any disclaimer, the term of this patent is extended or adjusted under 35 U.S.C. 154(b) by 489 days.

(21) Appl. No.: 18/360,954

(22) Filed: Jul. 28, 2023

(65) Prior Publication Data

US 2024/0050825 A1 Feb. 15, 2024

Related U.S. Application Data

(60) Provisional application No. 63/397,453, filed on Aug. 12, 2022.

(51) Int. Cl.
*A63B 63/08* (2006.01)
*A63B 63/00* (2006.01)

(52) U.S. Cl.
CPC ..... *A63B 63/083* (2013.01); *A63B 2063/001* (2013.01); *A63B 2210/50* (2013.01); *A63B 2220/17* (2013.01); *A63B 2220/833* (2013.01)

(58) Field of Classification Search
CPC ..... A63B 63/083; A63B 2063/001
See application file for complete search history.

(56) References Cited

U.S. PATENT DOCUMENTS

| | | | | |
|---|---|---|---|---|
| 1,275,649 | A * | 8/1918 | Blando | A47C 4/52 297/54 |
| 5,133,546 | A * | 7/1992 | Matherne | A63B 24/0021 273/375 |
| 5,692,976 | A * | 12/1997 | Yu | A63B 69/0071 473/433 |
| 6,565,460 | B2 * | 5/2003 | Wang | A63B 63/083 473/431 |
| 6,929,569 | B1 | 8/2005 | Wang | |
| 7,247,105 | B2 | 7/2007 | Huntsberger | |
| 9,533,210 | B2 | 1/2017 | Lee | |
| 10,220,281 | B2 | 3/2019 | Luo et al. | |

* cited by examiner

*Primary Examiner* — Brian O Peters
(74) *Attorney, Agent, or Firm* — Endurance Law Group PLC; James R. Yee

(57) ABSTRACT

A fold-up frame for portable basketball game device includes a base, a rear brace frame, and a backboard brace frame. The base has a base frame, a front leg structure and a rear leg structure. The front leg structure is rotatably coupled to a front side of the base frame, the rear leg structure is rotatably coupled to a rear side of the base frame. Each of the front and rear leg structures are moveable between an extended leg position and a storage leg position. The rear brace frame has a lower brace frame portion and an upper brace frame portion. The lower brace frame portion is rotatably coupled to the rear side of the base frame. The rear brace frame is moveable between a storage rear brace position and an extended rear brace position. The backboard brace frame is rotatably coupled to the upper brace frame portion.

19 Claims, 14 Drawing Sheets

FOLD-UP FRAME FOR A PORTABLE BASKETBALL GAME AND PORTABLE BASKETBALL GAME WITH FOLD-UP FRAME

CROSS REFERENCE TO RELATED APPLICATIONS

This application claims priority to U.S. Provisional Patent Application Ser. No. 63/397,453 filed on Aug. 12, 2022, the entire disclosure of which is hereby incorporated by reference and relied upon.

BACKGROUND OF THE INVENTION

Field of the Invention

The invention relates generally to portable sport games, and more particularly to a foldup frame for use with a portable sport game, such as basketball.

Background of the Invention

Home basketball games that allow two or more players compete against each other in basketball shooting games are very popular. Various versions of the home basketball games are available that may be configured to be used in basements, play rooms, garages, etc. . . . These games typically are mounted to free-standing frames and are configured to support one or more basketball nets. A basketball game controller and one or more sensors may be used to provide different games or games modes to control play of one or players. However, the free-standing frames generally take up a lot of room.

In addition, some of the free-standing frames are not very portable. It is desirable to provide a home style basketball game that folds up to a small configuration suitable for transport. The present invention is aimed to one or more of the problems identified above.

BRIEF SUMMARY OF THE INVENTION

In a first aspect of the present invention, a fold-up frame for a portable basketball game device, is provided. The fold-up frame includes a base, a rear brace frame and a backboard brace frame. The base has a base frame, a front leg structure and a rear leg structure. The base frame has a front side and a rear side. The front leg structure is rotatably coupled to the front side of the base frame. The rear leg structure is rotatably coupled to the rear side of the base frame. Each of the front and rear leg structures are moveable between an extended leg position and a storage leg position. The rear brace frame has a lower brace frame portion and an upper brace frame portion. The lower brace frame portion is rotatably coupled to the rear side of the base frame. The rear brace frame is moveable between a storage rear brace position and an extended rear brace position. The backboard brace frame is rotatably coupled to the upper brace frame portion. The backboard brace frame has a first brace coupled to a first side of the upper brace frame portion and a second brace coupled to a second side of the upper brace.

In a second aspect of the present invention, a fold-up frame for a portable basketball game device is provided. The fold-up frame includes a base, a front leg locking mechanism, a rear leg locking mechanism, a rear brace frame, a back brace frame, and a front frame. The base includes a base frame, a front leg structure and a rear leg structure. The base frame has a front side and a rear side. The front leg structure is rotatably coupled to the front side of the base frame. The rear leg structure is rotatably coupled to the rear side of the base frame. Each of the front and rear leg structures are moveable between an extended leg position and a storage leg position. The front leg locking mechanism is configured to lock the front leg structure in the extended position. The rear leg locking mechanism is configured to lock the rear leg structure in the extended position. The rear brace frame has a lower brace frame portion and an upper brace frame portion. The lower brace frame portion is rotatably coupled to the rear side of the base frame. The rear brace frame is moveable between a storage rear brace position and an extended rear brace position. The rear brace frame includes a pair of opposing rear brace frame sides and a rear brace frame upper side. Each of the rear brace frame sides has a top end and a bottom end. The rear brace frame upper side extends between the top ends of the opposing rear brace frame sides. The backboard brace frame is rotatably coupled to the upper brace frame portion. The backboard brace frame has a first brace coupled to a first side of the upper brace frame portion and a second brace coupled to a second side of the upper brace. Each of the first and second braces includes a vertical portion and a horizontal portion. The horizontal portion of the first and second braces are configured to extend over the base from when the fold-up frame is assembled. The backboard brace frame includes a first brace and a second brace. Each of the first and second brace includes a vertical portion and a horizontal portion. The backboard brace frame is mounted to the rear brace frame by a backboard brace rotational mechanism. Each of the first and second braces are rotatable the respective vertical positions between an extended position and a storage position. The front frame is rotatably coupled to the front side of the base frame and is moveable between a front frame storage front frame position and an extended front frame position. The fold-up frame further includes a ball return ramp coupled to the fold-up frame at a top of the rear brace frame and the front frame and a pair of retention sides coupled to opposite ends of the ball return ramp.

In a third aspect of the present invention, a portable basketball game is provided. The portable basketball game includes a fold-up frame. The fold-up frame includes a base, a rear brace frame, a backboard brace frame, and a front frame. The base has a base frame, a front leg structure and a rear leg structure. The base frame has a front side and a rear side. The front leg structure is rotatably coupled to the front side of the base frame. The rear leg structure is rotatably coupled to the rear side of the base frame. Each of the front and rear leg structures are moveable between an extended leg position and a storage leg position. The rear brace frame has a lower brace frame portion and an upper brace frame portion. The lower brace frame portion is rotatably coupled to the rear side of the base frame. The rear brace frame is moveable between a storage rear brace position and an extended rear brace position. The backboard brace frame is rotatably coupled to the upper brace frame portion. The backboard brace frame has a first brace coupled to a first side of the upper brace frame portion and a second brace coupled to a second side of the upper brace. The front frame is rotatably coupled to the front side of the base frame and being moveable between a front frame storage front frame position and an extended front frame position. The fold-up frame further includes a ball return ramp coupled to the fold-up frame at a top of the rear brace frame and the front frame and a pair of retention sides coupled to opposite ends of the ball return ramp. The portable basketball game further includes a backboard coupled to the backboard brace frame, a rim and a net coupled to the backboard, at least one sensor for detecting a basketball passing through the net, and a controller connected to the at least one sensor for providing a basketball game.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1A:
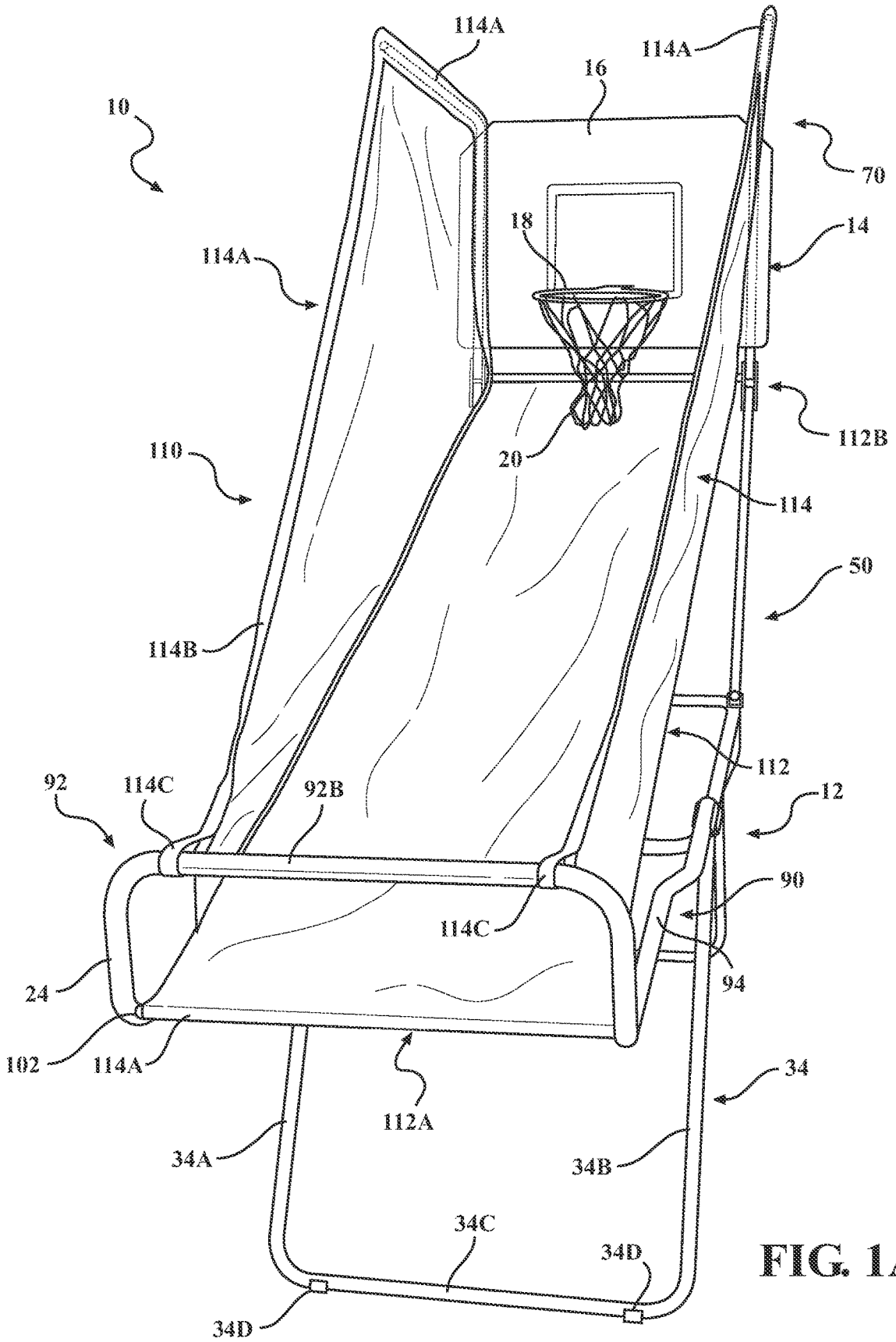
FIG. 1A is perspective view of a portable basketball game with a foldup frame and a basketball game assembly, according to an embodiment of the present invention.
Figure 1B:
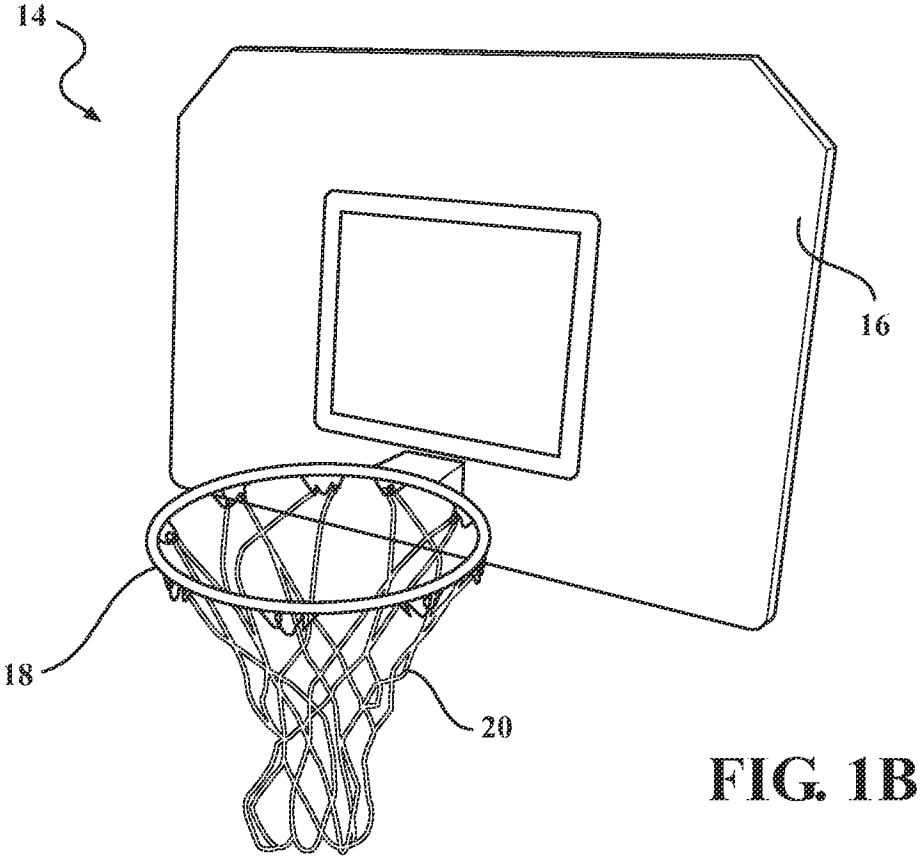
FIG. 1B is a perspective view of the basketball game assembly of the portable basketball game of FIG. 1A.
Figure 1C:
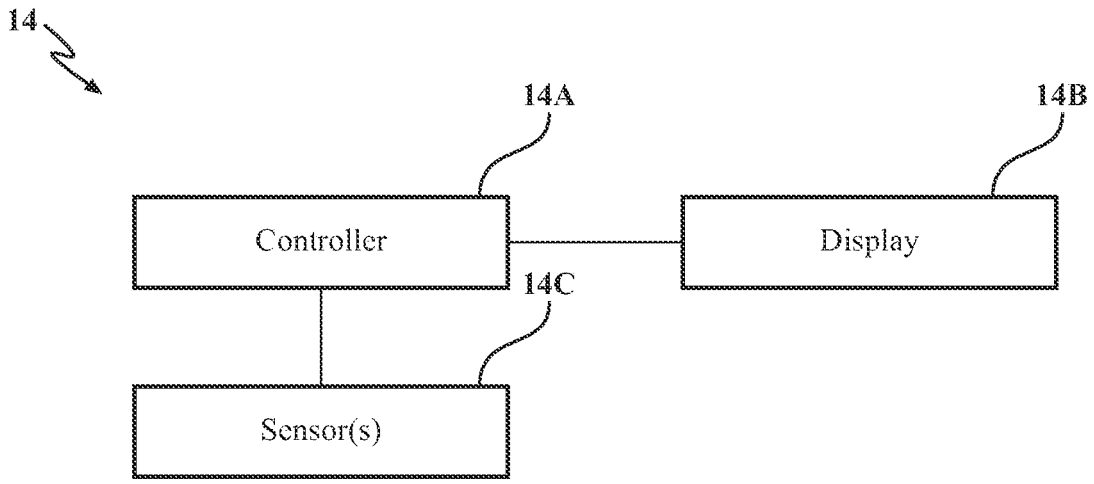
FIG. 1C is a partial block diagram of a basketball game assembly according to an embodiment of the present invention.

With reference to the drawings, and in operation, the present invention provides a portable basketball game 10. The portable basketball game 10 includes a foldup frame 12 and a basketball game assembly 14. The basketball game assembly 14 includes a backboard 16, a rim 18, a net 20, a controller 14A with a display 14B, and one or more sensors 14C for detecting a basketball passing through the net 20. In general, the basketball game assembly 14 provides a (countdown) timer and a counter for counting a number of basketball shots made through the net 20 during a predetermined time period. Detection of the number of shots made is performed by the sensors and displayed on the display. As will be discussed in more detail below, the foldup frame 12 may be configured between an open position (FIGS. 1A, 2A, and 2B) and a foldup position (FIG. 4J). In the foldup position, the portable basketball game 10 is suitable for transportation or storage. For example, the portable basketball game 10 may be inserted into a carry bag 200 with straps 202 for carrying. In one aspect of the present invention, the components of the foldup frame 12 are composed from tubular steel with a powder coat finish to protect from rust and chipping. With particular reference to FIGS. 2A-2B, the foldup frame 12 may include a base 30, a rear brace frame 50, a backboard base frame 70, and a front frame 90 (see below).

Figure 2A:
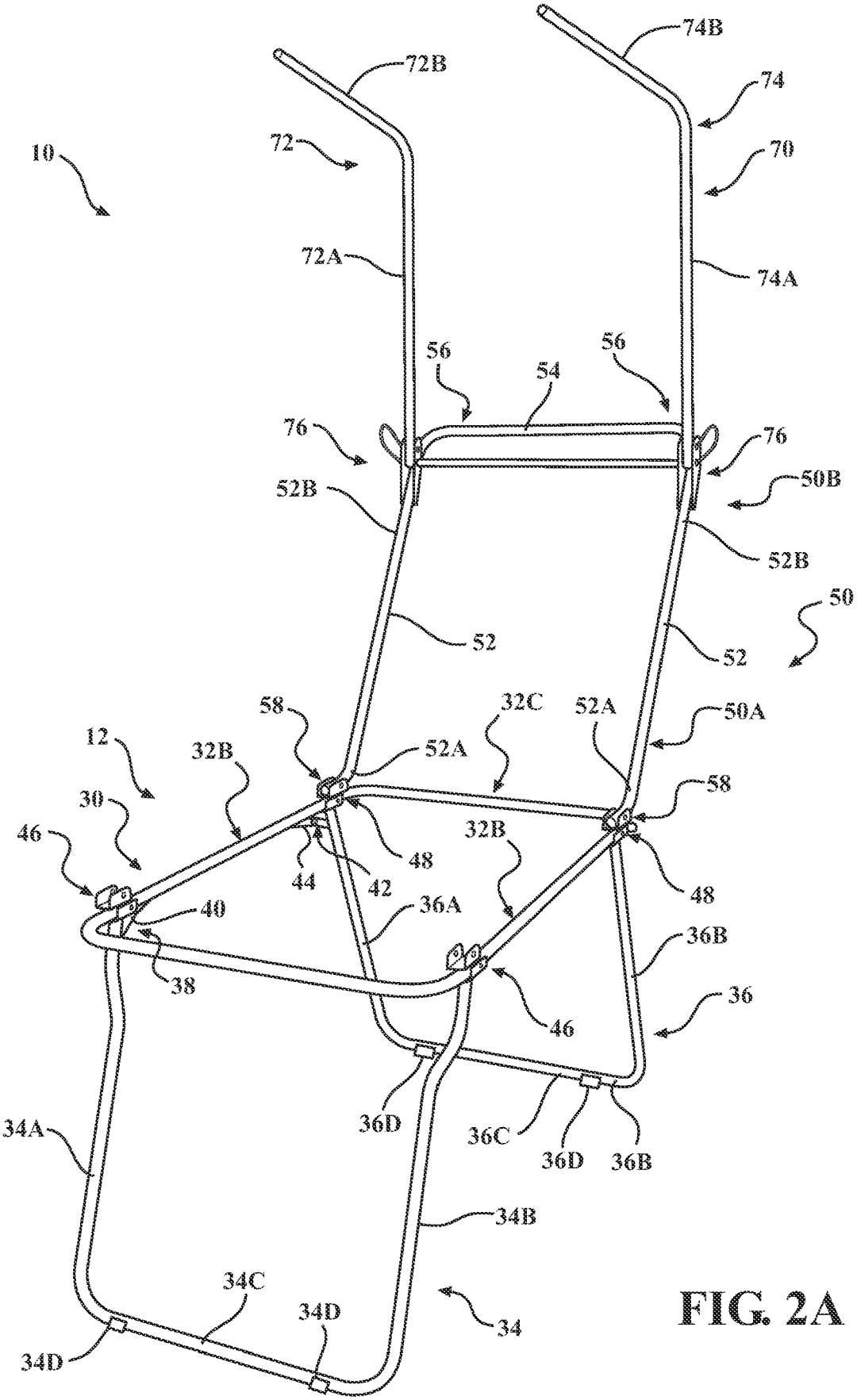
FIG. 2A is a first perspective view of the foldup frame of FIG. 1A having a base, a rear brace frame, a backboard brace frame.
Figure 2B:
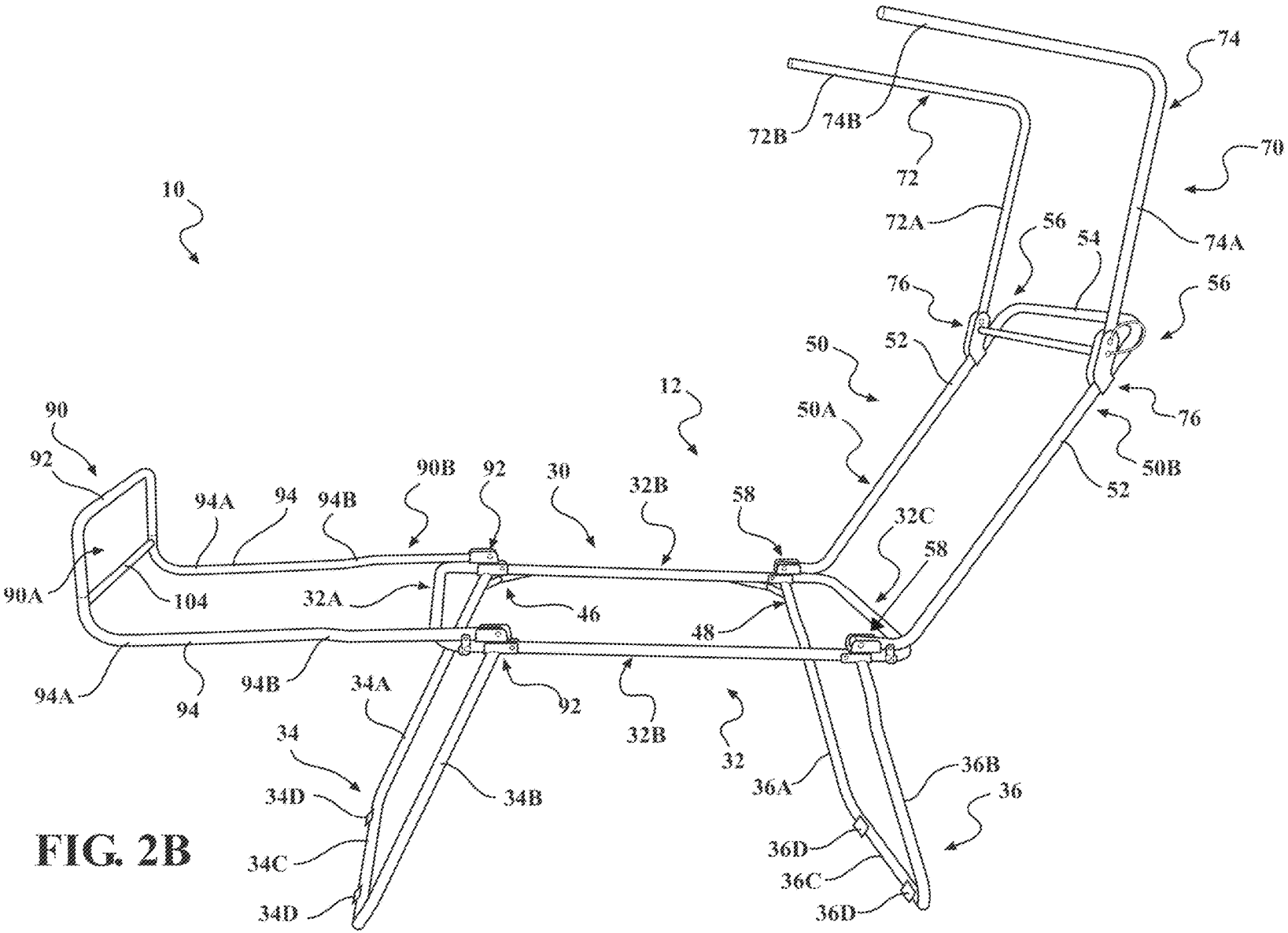
FIG. 2B is a second perspective view of the foldup frame of FIG. 2A having a base, a rear brace frame, a backboard brace frame and a front frame.

With particular reference to FIG. 1A, the portable basketball game 10 includes a flexible ball return 110. In the illustrated embodiment, the flexible ball return 110 includes a ball return ramp 112 and first and second retention sides 114. As discussed below, the ball return ramp 112 extends from a bottom of the net 20 to a front side of the front frame 90. During play, a player may stand adjacent the front side of the front frame 90 to shoot a basketball towards the rim 18. After the shot (whether the basketball passes through the net or is a miss), the retention sides 114 helps retain the basketball ball within the confines the portable basketball game and the ball return ramp 112 is angled downward towards the front of the front frame 90 such that the ball moves towards the front of the front frame 90 where the basketball ball may be reached by the player.

With particular reference to FIGS. 2A-2B, the base 30 includes a base frame 32, a front leg structure 34 and a rear leg portion 36. In the illustrated embodiment, the base member 32 has a generally rectangular shape with rounded corners. The base frame 32 has a front side 32A, two opposing sides 32B, and a rear side 32C.

The front leg structure 34 are rotatably coupled to the front side 32A of the base frame and the rear leg structure 36 are rotatably coupled to the rear side 32C of the base frame 32. Each of the front and rear leg structures 34, 36 are moveable between respective extended leg positions and storage leg positions. In the illustrated embodiment, the front leg structure 34 may be rotatably coupled to the base frame 32 at each of the opposing sides 32B near the front side 32A of the base frame 32.

Figure 3A:
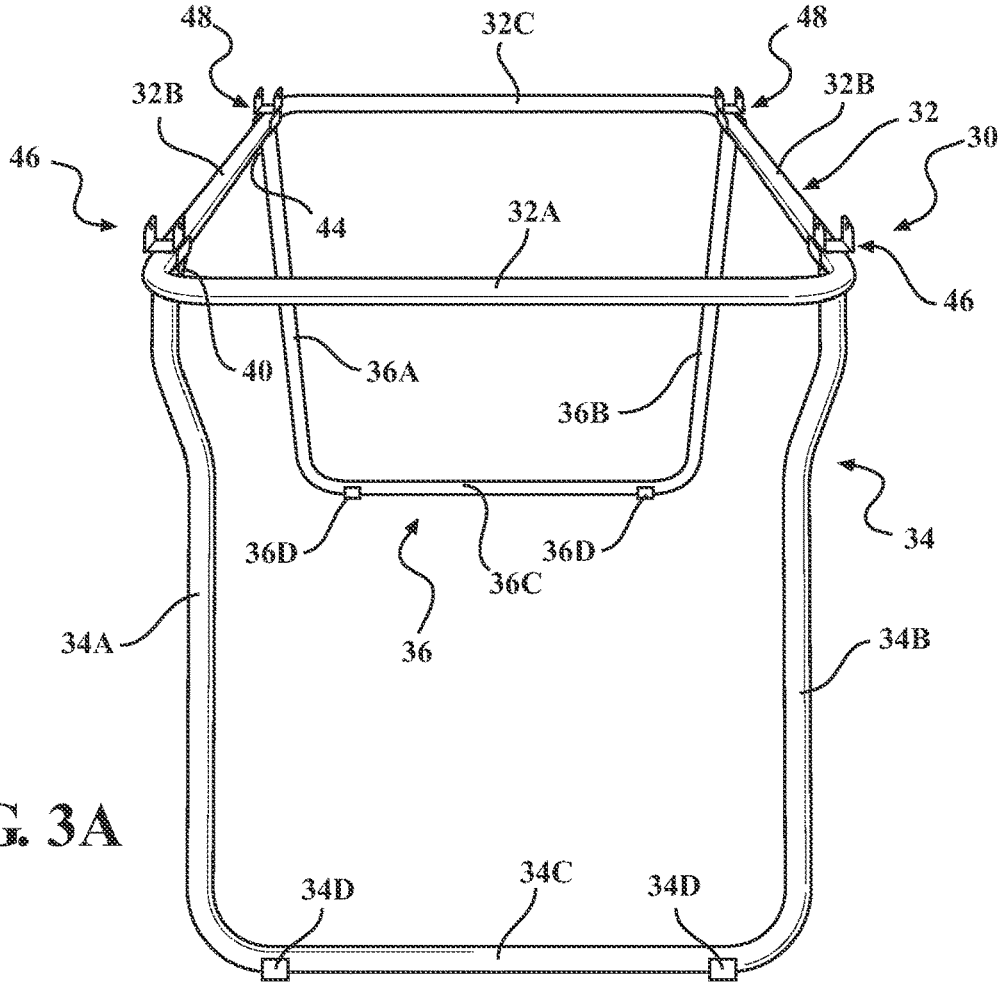
FIG. 3A is a first perspective view of a base frame of the base of FIG. 1A in an open configuration, according to an embodiment of the present invention.
Figure 3B:
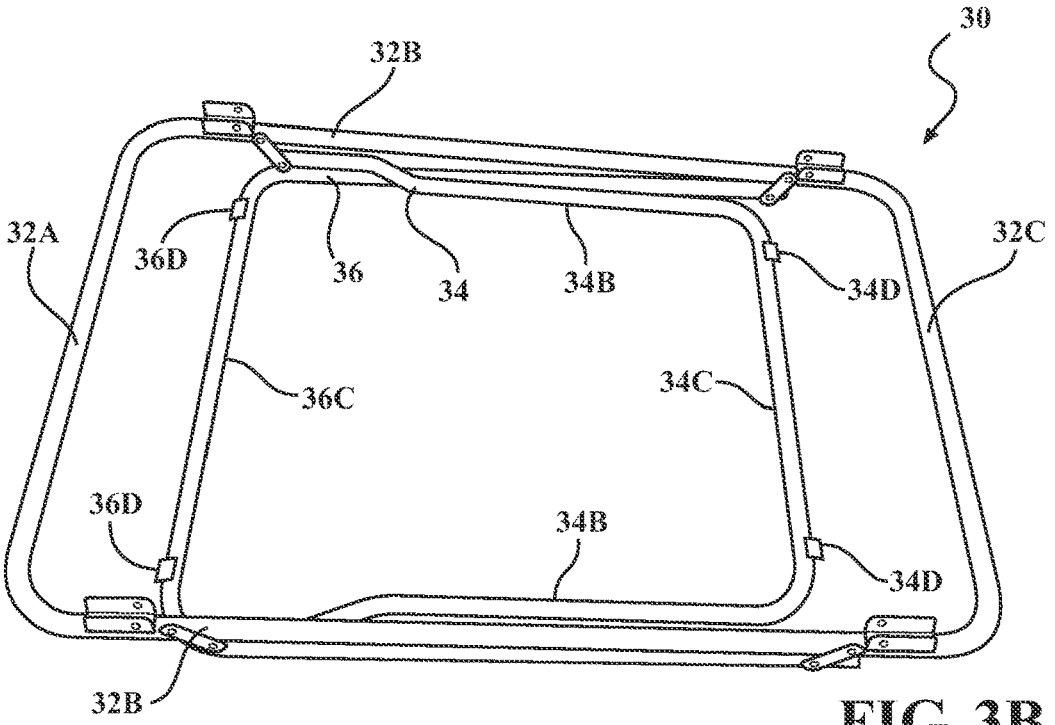
FIG. 3B is a second perspective view the base frame of FIG. 3A in a folded configuration.

As mentioned above, the front leg structure 34 is extendable between an extended position (FIGS. 1A, 2A, and 2B) and a storage position (FIGS. 3B and 4J). The front leg structure 34 includes a first leg 34A and a second leg 34B. The first and second legs 34A, 34B are rotatably coupled to the base frame 34 at an adjacent end. In the illustrated embodiment, a distant end of each of the first and second legs 34A, 34B may be connected by a bottom connector 34C. The front leg structure 34 may include a pair of clip-on protectors 34D to provide a non-slip surface or grip to the front leg structure 34 on slippery surfaces. When in the extended position the front leg structure 34 may be angled forward at an angle ($\alpha$) relative to the base frame 32. In one embodiment, $\alpha$ is greater than 90 degrees. In another embodiment, the $\alpha$ is approximately 120 degrees. In this context, the term "generally" means +/−five degrees which may account for manufacturing tolerances.

In another aspect of the present invention, a front leg locking mechanism 38 may be provided. The front leg locking mechanism 38 is configured to lock the front leg structure 34 in the extended position. In one embodiment, the front leg locking mechanism 38 is in the form of a front brace 40 coupled between the first leg 34A or the second leg 34B and the base frame 34. In the illustrated embodiment, the front brace 40 includes a first brace member 40A and a second brace member 40B. The first brace member 40A is rotatably coupled via a fastener (such as a rivet) to the one of the first and second legs 34A, 34B at one end thereof. The second brace member 40B is rotatably coupled via a fastener (such as a rivet) to the base frame 32 at one end thereof. The opposite ends of the first and second brace members 40A, 40B are rotatably coupled together via a fastener (such as a rivet). A detent feature may lock the brace 40 in a locking configuration. In one embodiment, the front leg locking mechanism 38 includes a front brace 40 associated with one of the first leg 34A and the second leg 34B. In another embodiment, the front leg locking mechanism 38 includes a front brace 40 associated with each of the first leg 34A and the second leg 34B.

The rear leg structure 36 is extendable between an extended position (FIGS. 1A, 2A, and 2B) and a storage position (FIGS. 3B and 4J). The rear leg structure 36 includes a first leg 36A and a second leg 36B. The first and second legs 36A, 36B are rotatably coupled to the base frame 34 at an adjacent end. In the illustrated embodiment, a distant end of each of the first and second legs 36A, 36B may be connected by a bottom connector 36C. The rear leg structure 36 may include a pair of clip-in protectors 36D to provide a non-slip surface or grip to the rear leg structure 36 on slippery surfaces. When in the extended position the rear leg structure 36 may be angled rearward at an angle (β) relative to the base frame 32. In one embodiment, β is greater than 90 degrees. In another embodiment, β may be approximately 120 degrees. In this context, the term "generally" means +/−five degrees which may account for manufacturing tolerances.

In another aspect of the present invention, a rear leg locking mechanism 42 may be provided. The rear leg locking mechanism 42 is configured to lock the rear leg structure 36 in the extended position. In one embodiment, the rear leg locking mechanism 42 is in the form of a rear brace 44 coupled between the rear leg 36A or the second leg 36B and the base frame 34. In the illustrated embodiment, the rear brace 44 includes a first brace member 44A and a second brace member 44B. The first brace member 44A is rotatably coupled via a fastener (such as a rivet) to the one of the first and second legs 36A, 36B at one end thereof. The second brace member 44B is rotatably coupled via a fastener (such as a rivet) to the base frame 32 at one end thereof. The opposite ends of the first and second brace members 44A, 44B are rotatably coupled together via a fastener (such as a rivet). A detent feature may lock the brace 44 in a locking configuration. In one embodiment, the rear leg locking mechanism 42 includes a front brace 44 associated with one of the first leg 36A and the second leg 36B. In another embodiment, the rear leg locking mechanism 38 includes a rear brace 44 associated with each of the first leg 36A and the second leg 36B.

Figure 2C:
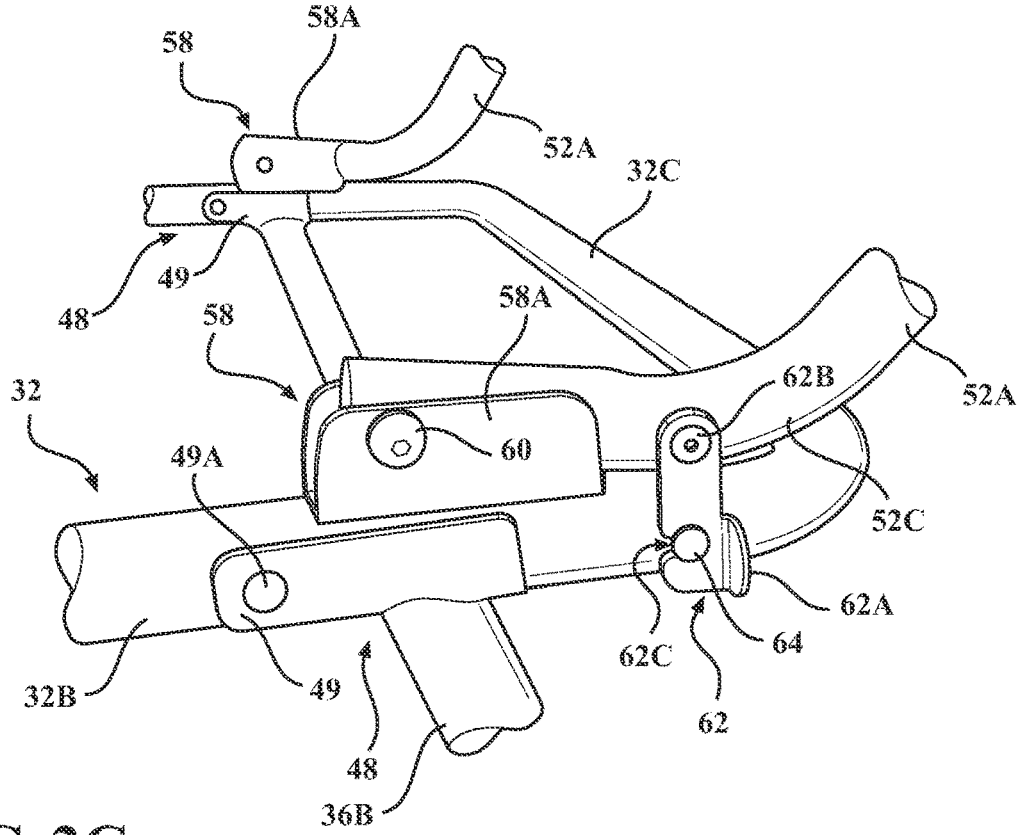
FIG. 2C is a perspective view of an upper rear hinge and a lower rear hinge of the foldup frame, according to an embodiment of the present invention.

Each of the first and second legs 34A, 34B, 36A, 36B of the front leg structure 34 and the rear leg structure 36 may be rotatably coupled to the base frame 32 by respective lower front hinges 46 and lower rear hinges 48. Each of the lower front and rear hinges 46, 48 may include a U-shaped bracket 49 connected at the end of the respective first and second legs 34A, 34B, 36A, 36B An enlarged view of one of the lower rear hinges 48 including the U-shaped bracket 49 is shown in FIG. 2C. The U-shaped bracket 49 is rotatably coupled to the base frame 32 by a suitable fastener. Each of the U-shaped bracket 49 may be welded to the top end of the respective legs 34A, 34B, 36A, 36B.

Referring again specifically to FIGS. 2A-2B, the rear brace frame 50 has a lower brace frame portion 50A and an upper brace frame portion 50B. The lower brace frame portion 50A is rotatably coupled to the rear side 32C of the base frame 32. The rear brace frame 50 is moveable between a storage rear brace position (shown in FIGS. 4I-4J) and an extended rear brace position (shown in FIGS. 2A-2B). In the illustrated embodiment, the rear brace frame 50 includes a pair of opposing rear brace frame sides 52 and a rear brace frame upper side 54. Each rear brace frame side 52 has a bottom end 52A and a top end 52B. The rear brace frame upper side 54 extends between the top ends 52B of the opposing rear brace frame side 52.

In one embodiment, the rear brace frame 50 is composed from two mirrored portions 56 with a junction located in a middle portion of the rear brace frame upper side 54. One end of one of the two mirrored portions 56 is tapered and fits within the opposing end of the other of the two mirrored portions 56 via a friction fit.

Figure 4A:
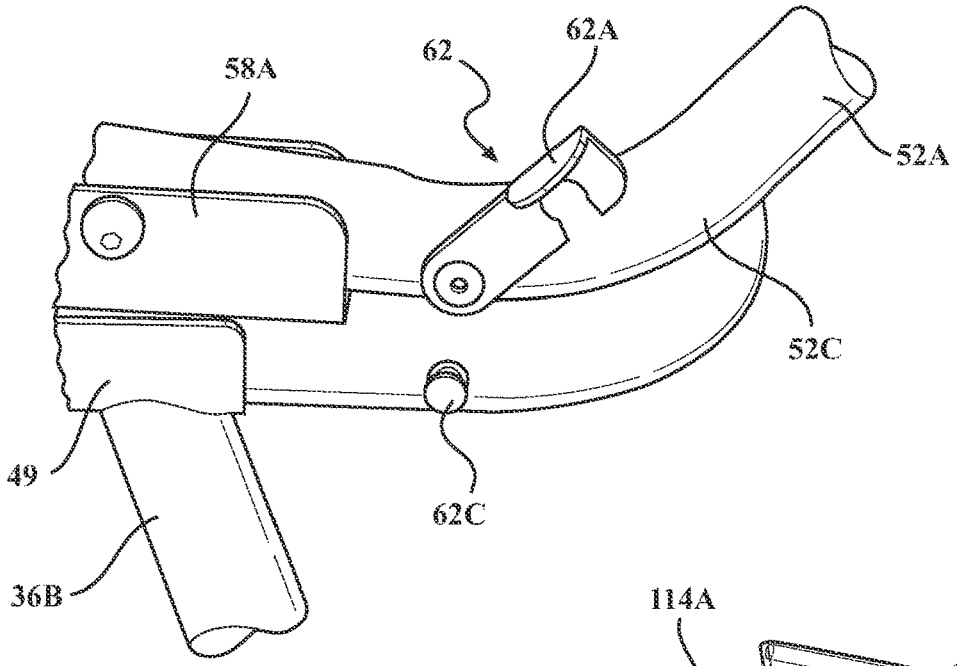
FIGS. 4A-4K are perspective views of the portable basketball game during a foldup process, according to an embodiment of the present invention.
Figure 4B:
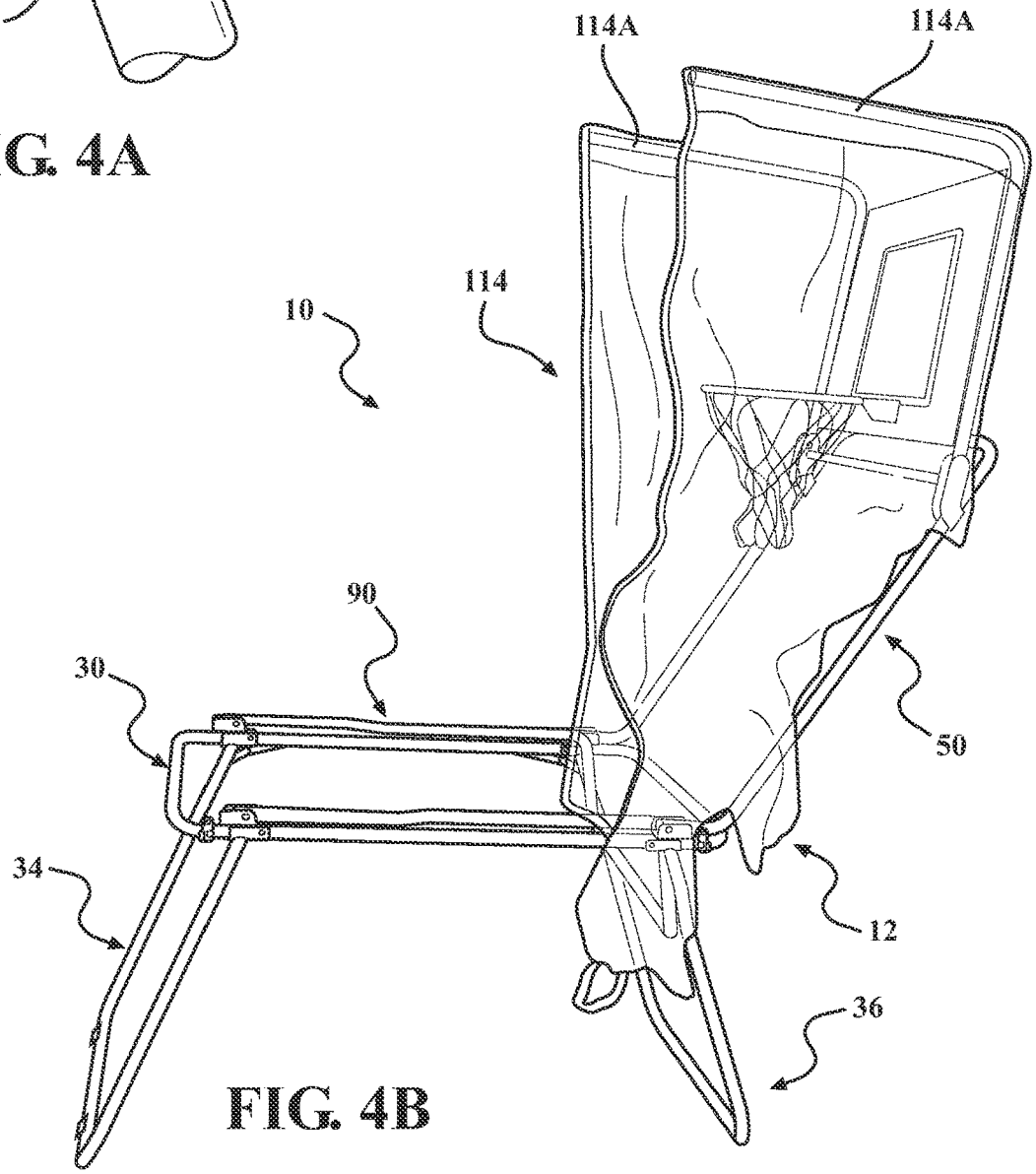
Figure 4C:
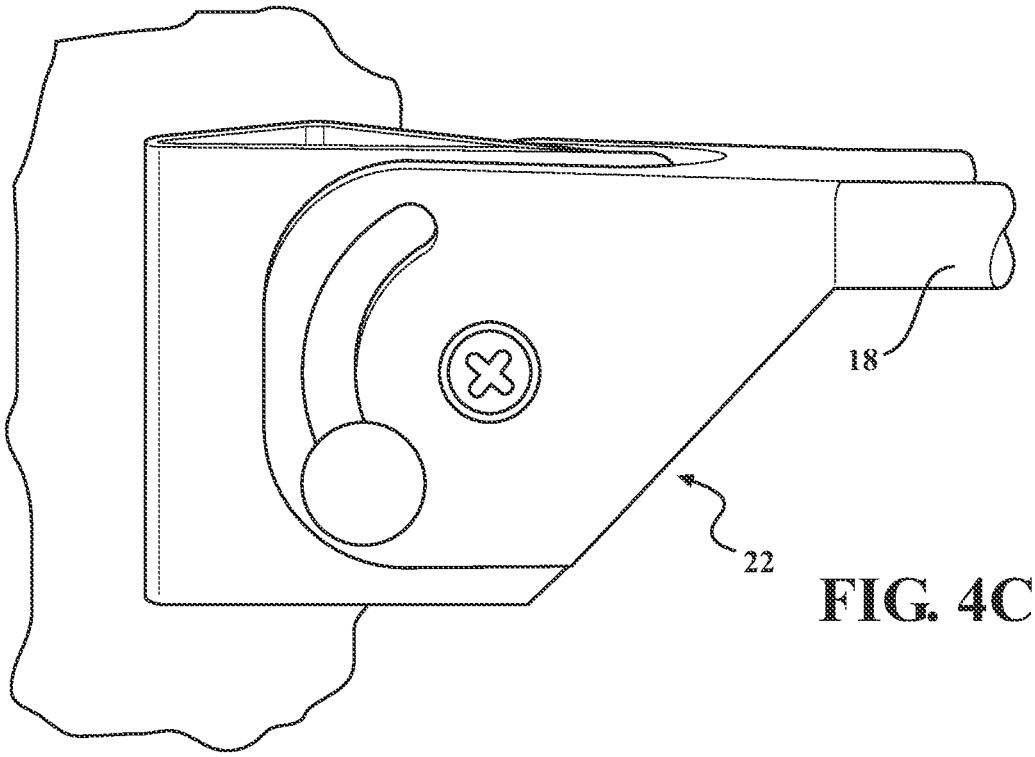
Figure 4D:
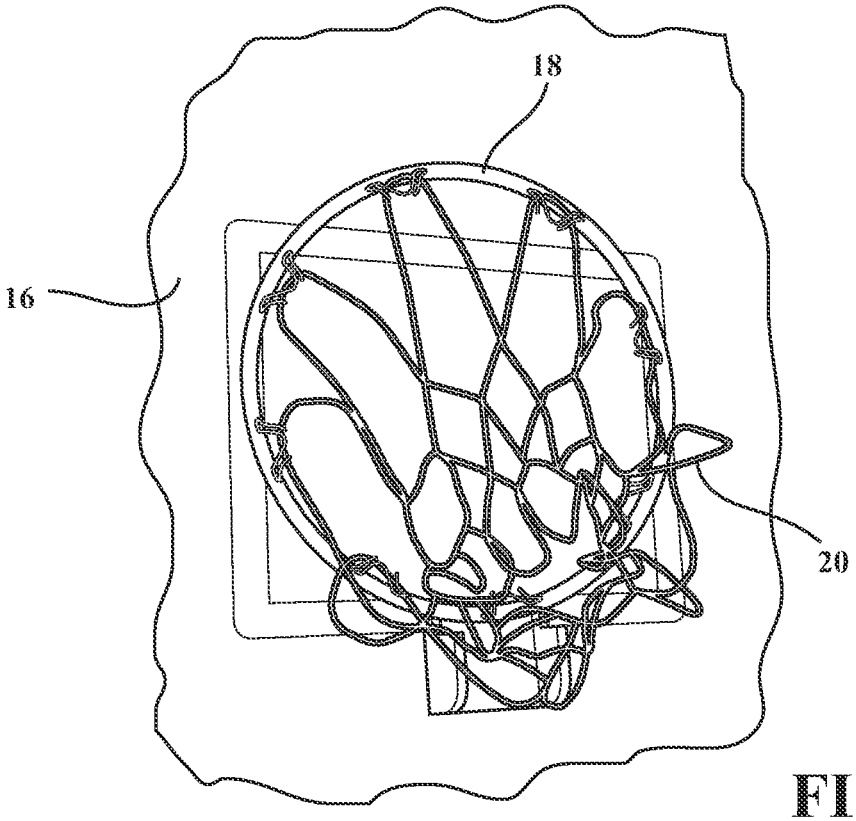
Figure 4E:
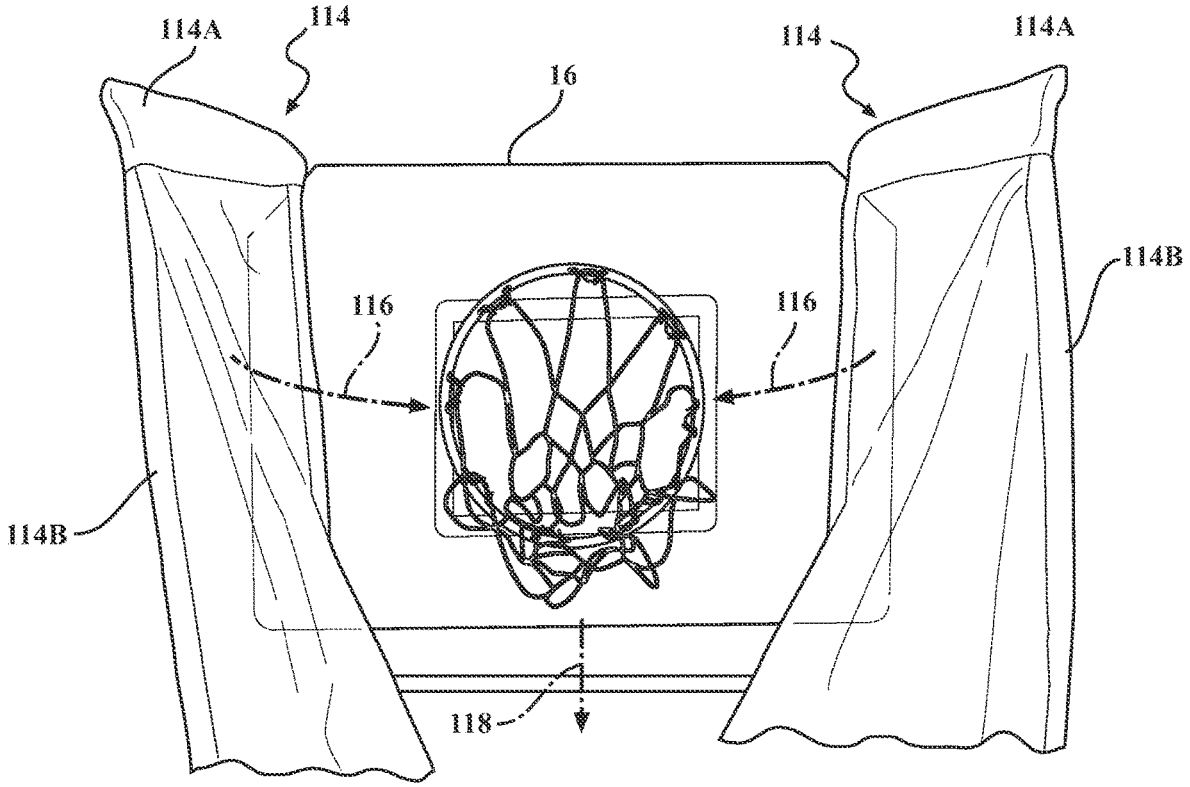
Figure 4F:
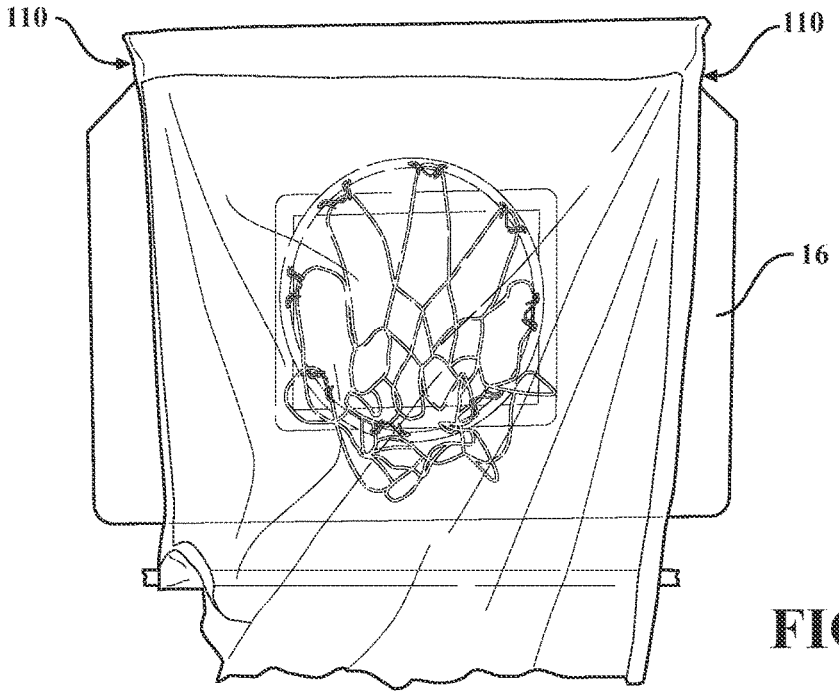
Figure 4G:
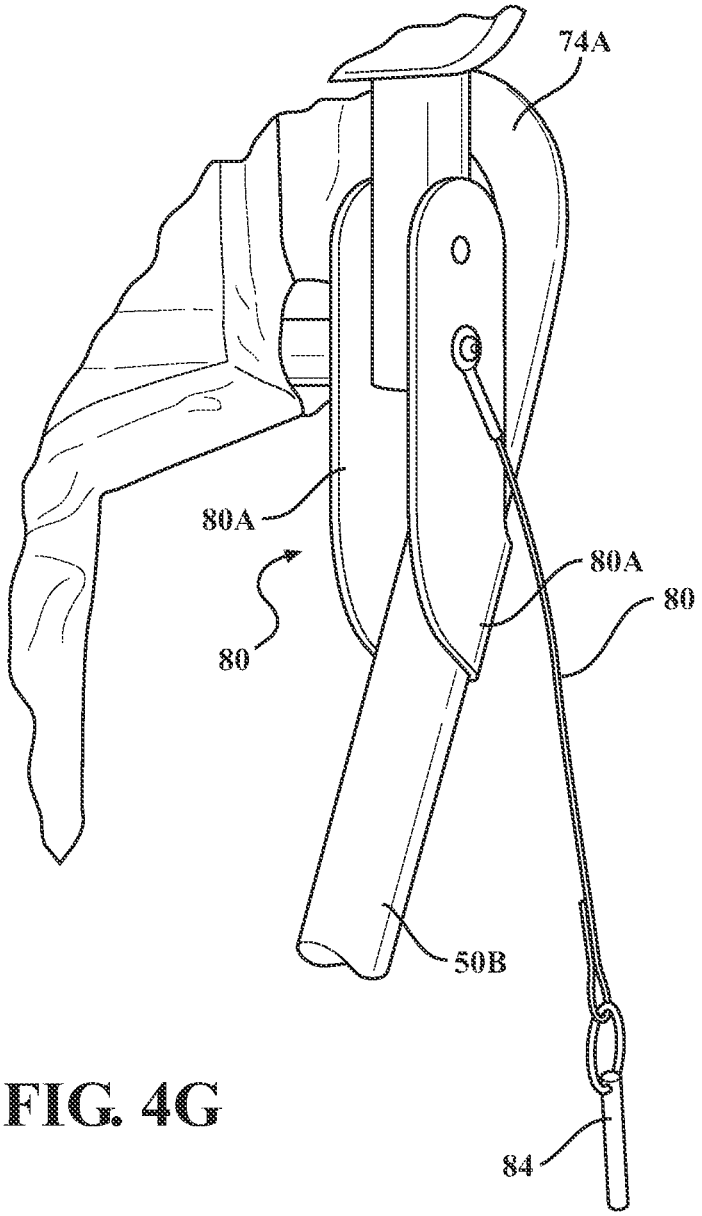
Figure 4H:
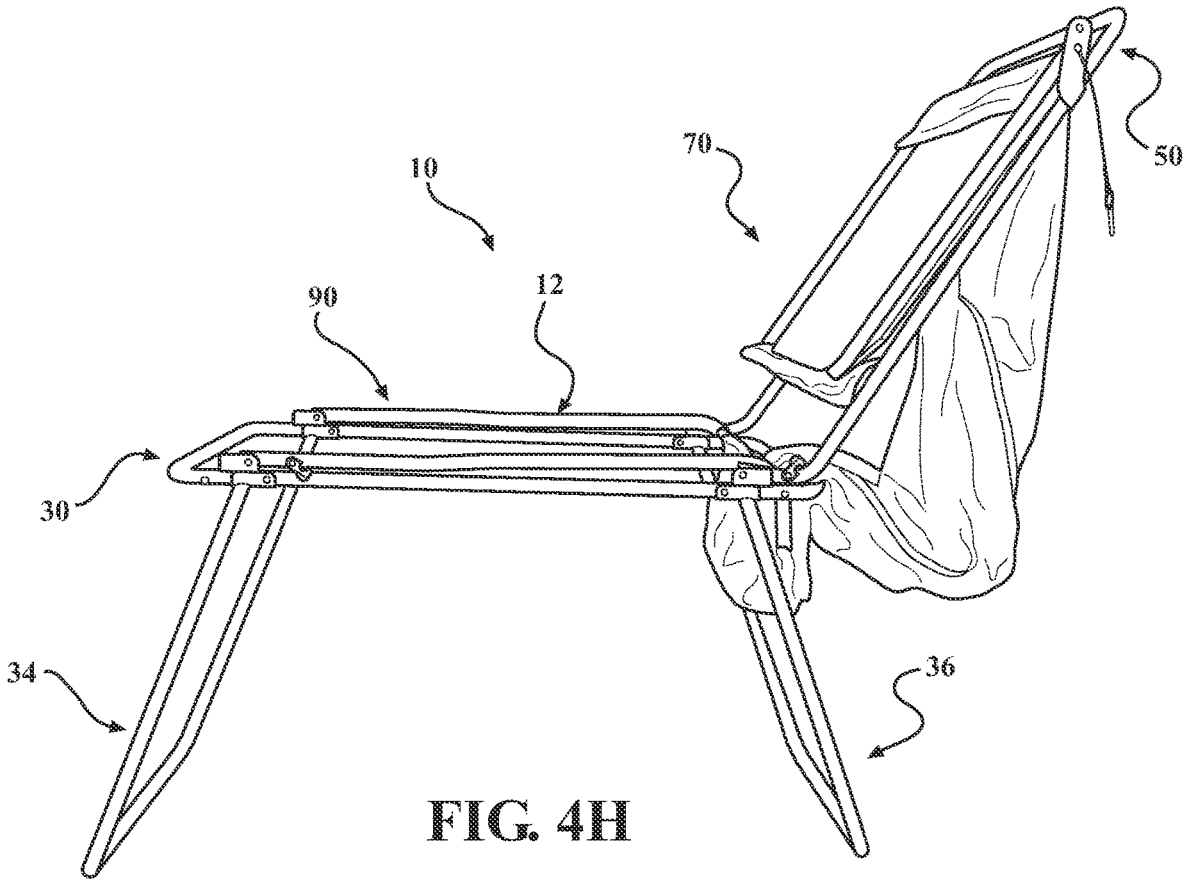

With particular reference to FIGS. 2C, 4A, 4H, the rear brace frame 50 is rotatably coupled to a rear side 32C of the base frame 32 via a pair of upper rear hinges 58. In the illustrated embodiment, each rear hinge 58 includes an upper hinge U-shaped bracket 58A connected to the base frame 50, for example, by welding. The bottom end 52A of each rear brace frame side 52 has a curved portion 52C. One end of the curved portion 52C may be rotatably coupled to the U-shaped bracket 58A by a suitable fastener 60 (such as a bolt and nut). The curved portion 52C extends rearward toward the rear side 32C of the base frame 32 to provide support for the rear brace frame 50 and components mounted thereto, including the basketball game assembly 14.

A pair of latches 62 are coupled between the base frame 32 and each side of the rear brace frame 50 and are configured to controllably maintain the rear brace frame 50 in the extended rear brace position. One of the latches 62 is illustrated in FIG. 4A. In the illustrated embodiment, each latch 62 includes a latch member 62A rotatably coupled to the curved portion 52C of the bottom end 52A of the rear brace frame side 52 by a suitable fastener such as a rivet 62B. In the illustrated embodiment, the latch member 62A includes an open aperture 62B that is configured to receive a pin 64 mounted to the base frame 32.

Figure 4I:
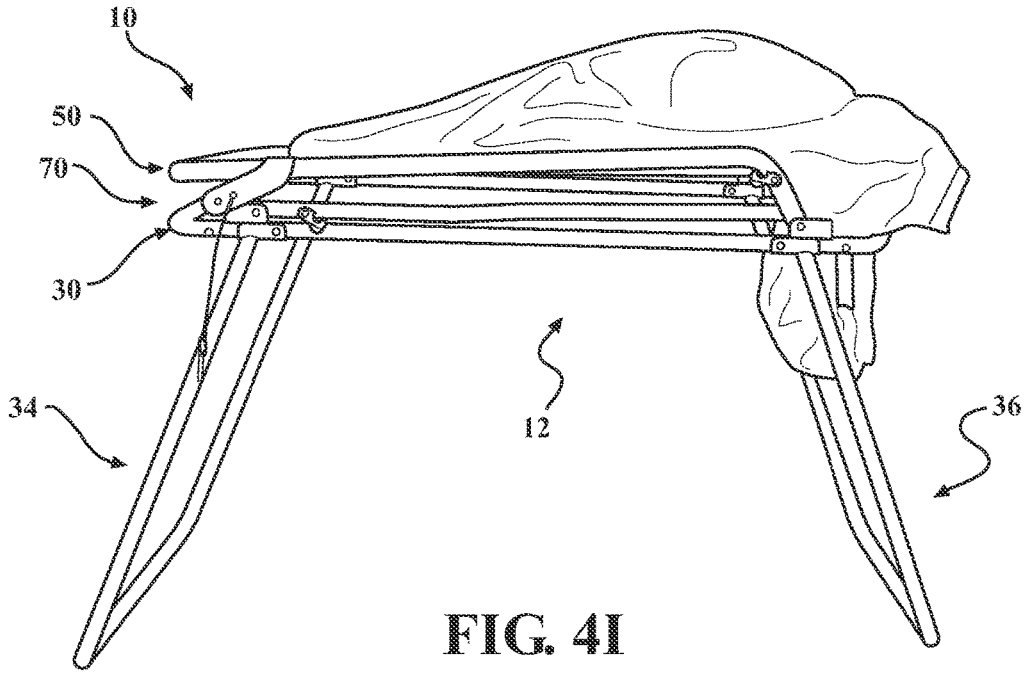
Figure 4J:
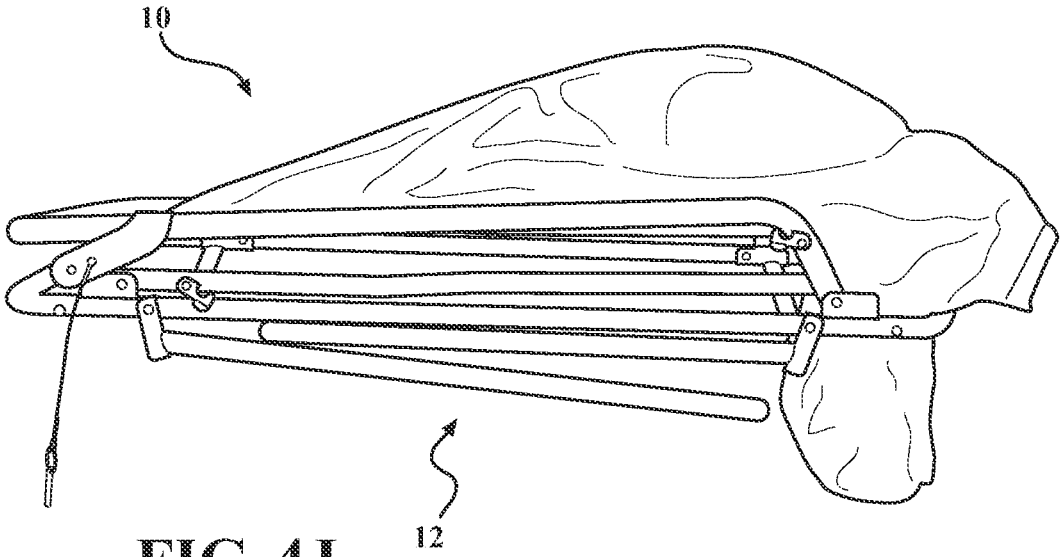

Returning to FIGS. 2A-2B and 4B, the backboard brace frame 70 is rotatably coupled to the upper brace frame portion 50B of the backboard brace frame 50 between an extended position (shown in FIGS. 1A, 2A-2B, 4B) and a storage position (shown in FIGS. 4H-4J). In the illustrated embodiment the backboard brace frame 70 includes a first brace 72 and a second brace 74. The first brace 72 of the backboard brace frame 70 is coupled to a first side of the upper brace frame portion 50B. The second brace 74 is coupled to a second side of the upper brace frame portion 50B. In the illustrated embodiment, each of the first and second braces 72, 74 may also include a vertical portion 72A, 74A and a horizontal portion 72B, 74B. As shown in FIG. 1A, the backboard 16 of the basketball game assembly 14 is mounted to the vertical portions 72A, 74A of the first and second braces 72, 74 by a plurality of suitable fasteners (such as bolts and nuts).

Figure 2D:
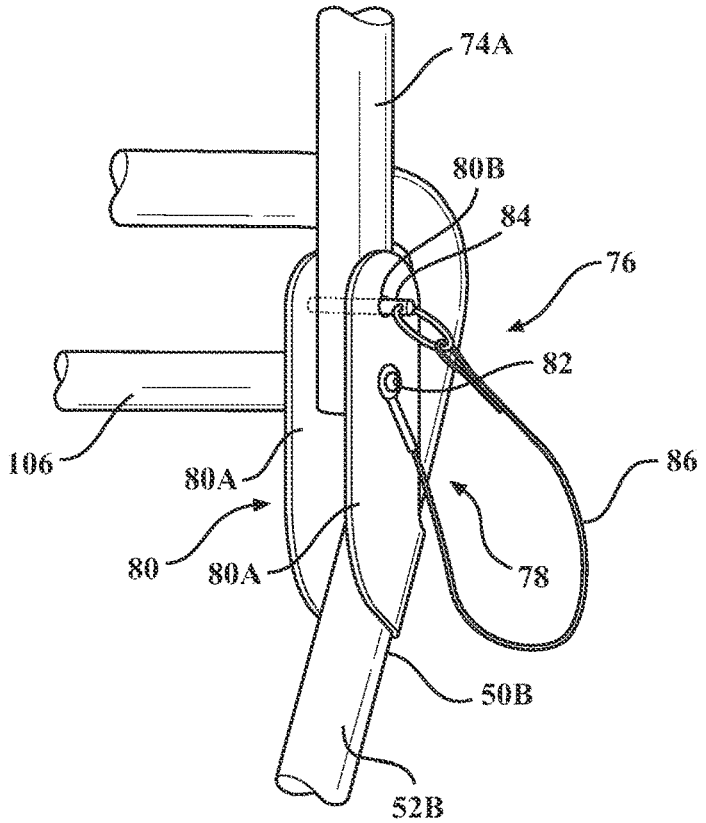
FIG. 2D is a perspective view of a backboard hinge of the foldup frame, according to an embodiment of the present invention.

In the illustrated embodiment the backboard brace frame 70 is mounted to the rear brace frame 50 by a backboard brace rotational mechanism 76 (see FIG. 2D). The backboard brace rotational mechanism 76 may include a backboard brace hinge 78 located at either side of the upper brace frame portion 50B.

With reference to FIG. 2D, each backboard brace hinge 78 (only one of which is shown in FIG. 2D) may includes a bracket 80 with opposing sides 80A. In the illustrated embodiment, the bracket 80 is fastened, for example, by welding, to the top end 52B of each rear brace frame side 52.

A lower part of each of the first and second braces 72, 74 may be rotatably coupled to the bracket 80 by a suitable fastener 82, such as a bolt and nut. A removable pin 84 may be removably inserted into an aperture 80B in each of the opposing sides 80A of the bracket. A flexible retention member 86 has one end coupled to the bracket 80 and a second end coupled to the removable pin 84 to keep the removable pin 84 coupled to the bracket 80 when the removable pin 84 is removed from the aperture 80B in the bracket 80. The removable pin 84 is configured to lock the backboard brace frame 70 in the extended position.

The first and second braces 72, 74 are rotatable about the respective vertical portions 72A, 74A between extended positions (shown in FIGS. 1A, 2A-2B, 2E, 4B, 4E) and a storage position (shown in FIG. 4E). In the extended position, the horizontal portions 72B, 74B of the first and second braces 72, 74 extend over the base frame 32. In the storage position, the horizontal portions 72B, 74B of the first and second braces 72, 74 are rotated inward such that the vertical portions 72A, 74A and the horizontal portions 72B, 74B are roughly planar (see FIGS. 4H-4J). As discussed in further detail below, the retention sides 14 of the ball return are supported by the horizontal portions 72B, 74B of the first and second braces 72, 74.

Figure 2E:
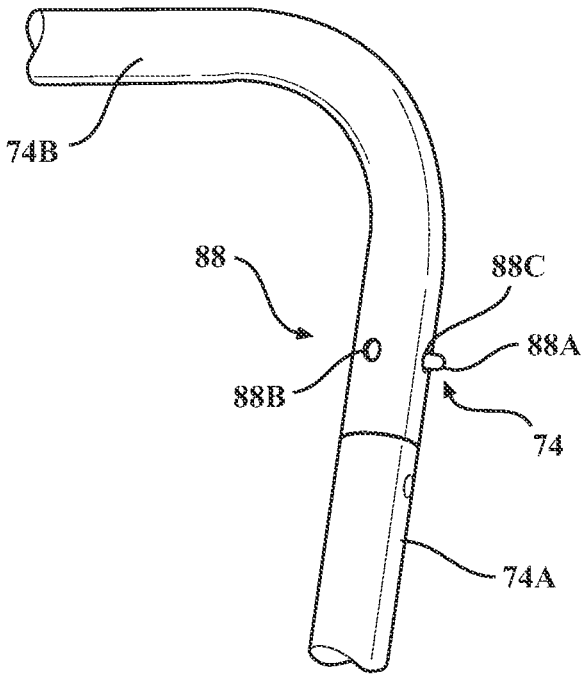
FIG. 2E is a perspective view of a backboard brace rotational mechanism of the foldup frame, according to an embodiment of the present invention.

With particular reference to FIG. 2E in the illustrated portion, the vertical portion 72A, 74A includes a tapered portion configured to fit within an open end of the respective horizontal portion 72B, 74B with a loose fit to allow the horizontal portions 72B, 74B to rotation about the respective vertical portions 72A, 74A. A locking mechanism 88 may be provided that is configured to lock the respective horizontal portions 72B, 74B in the extended and storage positions. In the illustrated embodiment each locking mechanism includes a spring biased locking pin 88A mounted to the tapered portion of each vertical portion 72A. The open end of each horizontal portion 72B, 74B includes first and second apertures 88B, 88C configured to receive the spring biased locking pin 88A to lock the horizontal portion 72B, 74B in the extended and storage positions.

With reference to FIGS. 1A and 2B, the front frame 90 is rotatably coupled to a front side 32 of the base frame 32B. As shown, the front frame 90 includes a first front frame end 90A and a second front frame end 90B. The front frame 90 is composed from a front member (or lean bar) 92 and two opposing side members 94 of the front frame 92. Each of the opposing side members 94 has a first end 94A coupled to opposite open ends 92A of the front member 92. In one embodiment, the first end 94A is tapered and configured to fit within the opposite open end 92A of the front member 92 and fastened thereto by a suitable fastener).

Figure 2F:
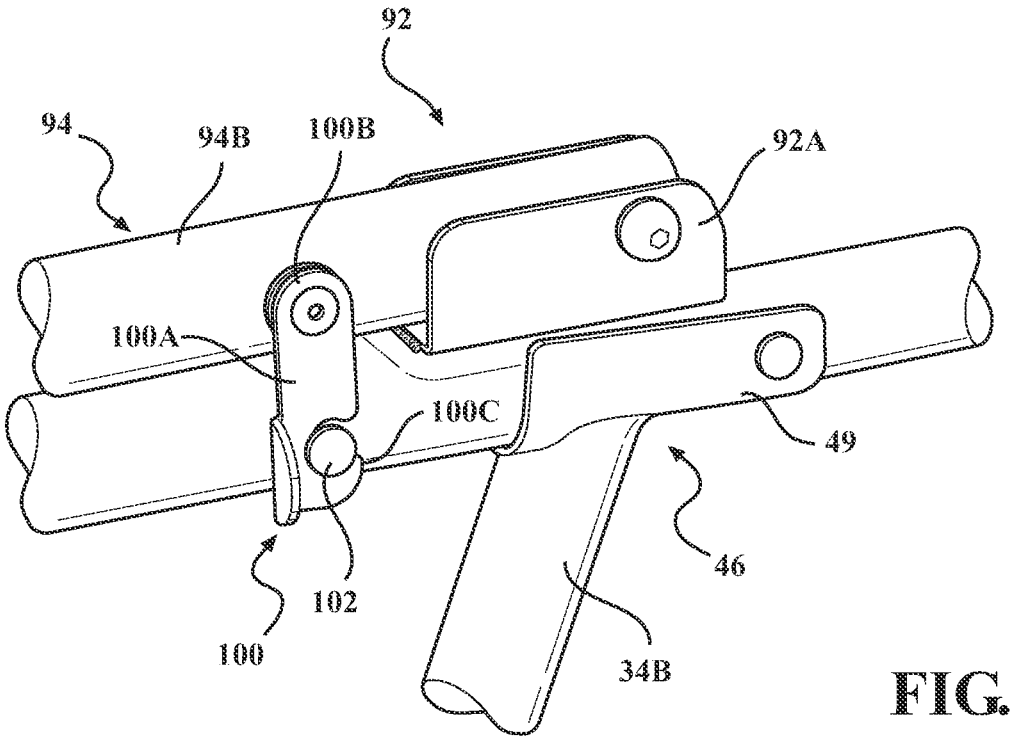
FIG. 2F is a perspective view of an upper front hinge and a lower front hinge, according to an embodiment of the present invention.

In the illustrated embodiment, the front frame 90 is moveable between an extended position (shown in FIG. 1A, 2B) and a storage position (shown in FIGS. 4B and 4H). With particular reference to FIG. 2F, in one embodiment, the front frame 90 is coupled to the front side 32 of the base frame 32B via a pair of upper front hinges 92. With particular reference to FIG. 2F, each of the upper front hinges 92 (only which is shown in FIG. 2F), includes a U-shaped upper front hinge bracket 92A which is coupled to, for example, by welding, adjacent the front side 32 of the base frame 32. In the illustrated embodiment, each U-shaped upper front hinge bracket 92A is fastened to an upper surface of the sides 32B of the base frame 32. A second end 94B of each side member 94 is rotatably coupled to the U-shaped upper front hinge bracket 92A by a suitable fastener 98 (such as a bolt and nut).

The side members 94 extend away from the U-shaped upper front hinge bracket 92A and are supported by the base frame 32 when the front frame 90 is in the extended position. A pair of latches 100 are coupled between each side of the front frame 90 and the base frame 32 and are configured to controllably maintain the front frame 90 in the extended position. One of the latches 100 is shown in FIG. 4F. In the illustrated embodiment, the latch 100 includes a latch member 100A rotatably coupled to the front frame 90 by a suitable fastener 100B such as a rivet. In the illustrated embodiment, the latch member 100A includes an open aperture 100C that is configured to receive a pin 102 mounted to the base frame 32.

In the illustrated embodiment, the front member 92 includes two side portions 92A which extend upward and away from the side members 94 and an upper portion 92B extending between the two side portions 92A. A front cross tube 104 extends between the junction between the side portions 92A and each side members 94. A rear cross tube 106 extends between, and is secured to, the brackets 80 of the backboard brace hinges 78 (see FIGS. 2A, 2B and 2D).

With particular reference to FIG. 1A, the ball return ramp 112 is made from a flexible material such as nylon. The ball return ramp 112 has a front end 112A and a rear end 112B. The front end 112A includes a sleeve 112C configured to receive the front cross tube 104 to secure the front end 112A of the ball return ramp 112 to the foldup frame 12. The ball return ramp 112 extends from the first end 112A towards the rear side of the base frame 32 around the rear cross tube 106 and is fastened to the rear of the backboard base frame 70 by a plurality of fasteners (not shown).

The retention sides 114 are connected to opposite sides of the ball return ramp 112. Each retention side 114 may be comprised primarily of a netting material. Each retention side 114 may include a sleeve 114A locating opposite the ball return ramp 112. The sleeves 114A are configured to receive the horizontal portion 72A, 74A of the first and second braces 72, 74. The remaining sides of the retention sides 114 may include a nylon border 114B. A plurality of velcro straps 114C may be connected to the border 114B or the retention sides 114 to assist in correctly positioning the retention sides 114 relative to the foldup frame 12.

With reference to FIGS. 4A-4K, the portable basketball game 10 may be folded up and/or manipulated into a storage configuration. It should be noted that the steps described below do not necessarily need to be performed in the order described.

With reference to FIG. 4A, the latches 62, 100 are manipulated to release the latch member 62A, 100A from the pin 62B, 102 to release the front frame 90. The front frame 90 may then be moved from the extended position to the storage position (shown in FIG. 4B). With reference to FIG. 4C, the rim 18 includes a detent mechanism 22 which allows the rim 18 to be rotated and placed in a storage position (shown in FIG. 4D).

As shown in FIGS. 4E-4F, the spring biased locking pins 88A may be pushed inward to release the first and second braces 72, 74. The first and second braces 72, 74 may be rotated inward (in the direction of arrows 116) from the extended position to the storage position (shown in FIG. 4F).

With particular reference to FIGS. 4G-4H, after the first and second braces 72, 74 are moved to the storage positions, the removable pin 84 is removed from the apertures 80B in the backboard brace rotational mechanism 76. The backboard base frame 70 may then be moved (in direction of arrow 118 in FIG. 4E) from the extended position to the storage position shown in FIG. 4H.

Figure 4K:
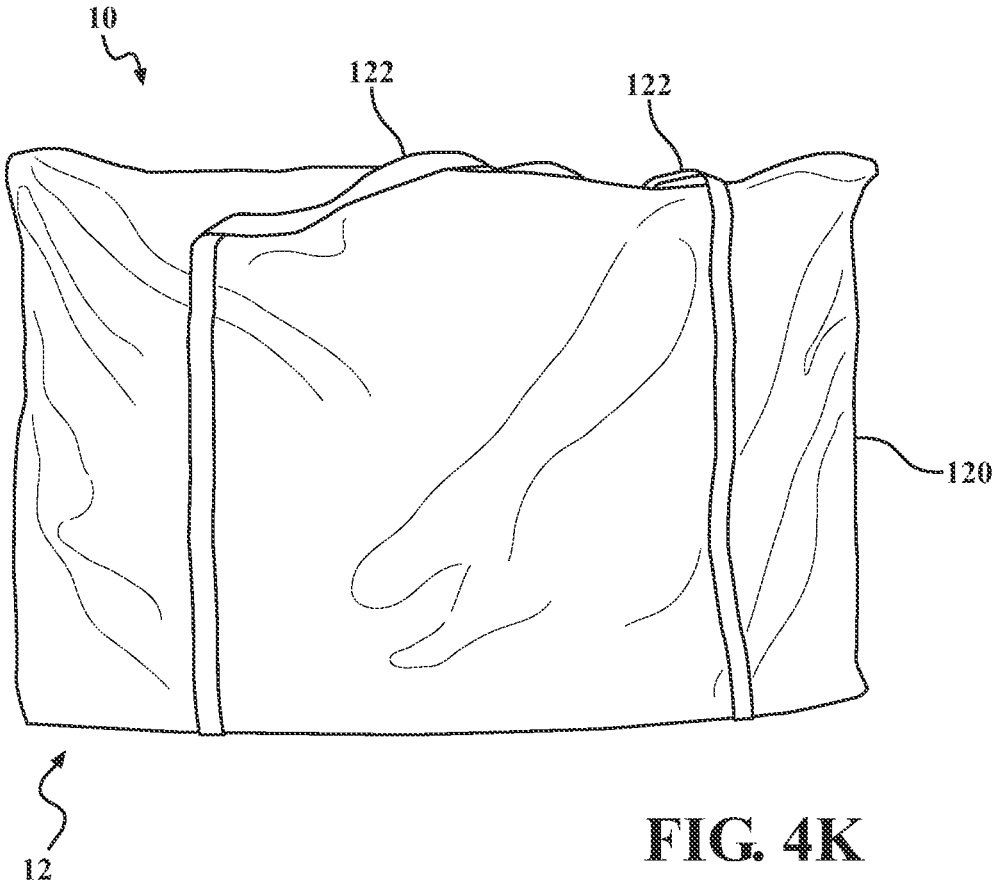

With reference to FIGS. 4I-4K, the front and rear leg locking mechanisms 38, 42 may be released and t+he front and rear leg structures 34, 36 may be manipulated from the extended positions into the storage positions (shown in FIG. 4J). In FIG. 4A, all components are in the respective storage positions and the foldup frame 12 is relatively flat (as shown). The portable basketball game 12 may then by inserted into a storage bag 120 for storage and/or transportation (see FIG. 4K).

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A fold-up frame for a portable basketball game device, comprising:

a base having a base frame, a front leg structure and a rear leg structure, the base frame having a front side and a rear side, the front leg structure being rotatably coupled to the front side of the base frame, the rear leg structure being rotatably coupled to the rear side of the base frame, each of the front and rear leg structures being moveable between an extended leg position and a storage leg position;

a rear brace frame having a lower brace frame portion and an upper brace frame portion, the lower brace frame portion being rotatably coupled to the rear side of the base frame, the rear brace frame being moveable between a storage rear brace position and an extended rear brace position;

a backboard brace frame rotatably coupled to the upper brace frame portion, the backboard brace frame having a first brace coupled to a first side of the upper brace frame portion and a second brace coupled to a second side of the upper brace;

a front frame rotatably coupled to a front side of the base frame and being moveable between extended position and a storage position; and, a ball return ramp coupled to the fold-up frame at a top of the rear brace frame and the front frame.

2. The fold-up frame, as set forth in claim 1, including:

a front leg locking mechanism for locking the front leg structure in the extended position; and, a rear leg locking mechanism for locking the rear leg structure in the extended position.

3. The fold-up frame, as set forth in claim 2, the front leg structure including a first leg of the front leg structure and a second leg of the front leg structure, the front leg locking mechanism including a front brace associated with at least one of the first leg of the front leg structure and the second leg of the front leg structure, the rear leg structure including a first leg of the rear leg structure and a second leg of the rear leg structure, the rear leg locking mechanism including a rear brace associated with at least one of the first leg of the rear leg structure and the second leg of the rear leg structure.

4. The fold-up frame, as set forth in claim 1, including a pair of retention sides coupled to opposite ends of the ball return ramp.

5. A fold-up frame for a portable basketball game device, comprising:

a base having a base frame, a front leg structure and a rear leg structure, the base frame having a front side and a rear side, the front leg structure being rotatably coupled to the front side of the base frame, the rear leg structure being rotatably coupled to the rear side of the base frame, each of the front and rear leg structures being moveable between an extended leg position and a storage leg position;

a rear brace frame having a lower brace frame portion and an upper brace frame portion, the lower brace frame portion being rotatably coupled to the rear side of the base frame, the rear brace frame being moveable between a storage rear brace position and an extended rear brace position;

a backboard brace frame rotatably coupled to the upper brace frame portion, the backboard brace frame having a first brace coupled to a first side of the upper brace frame portion and a second brace coupled to a second side of the upper brace;

a front leg locking mechanism for locking the front leg structure in the extended position; and a rear leg locking mechanism for locking the rear leg structure in the extended position, the front leg structure including a first leg of the front leg structure and a second leg of the front leg structure, the front leg locking mechanism including a front brace associated with at least one of the first leg of the front leg structure and the second leg of the front leg structure, the rear leg structure including a first leg of the rear leg structure and a second leg of the rear leg structure, the rear leg locking mechanism including a rear brace associated with at least one of the first leg of the rear leg structure and the second leg of the rear leg structure, wherein each of the first and second legs of the front leg structure and the rear leg structure is rotatably coupled to the base frame by respective hinges, each hinge including a U-shaped bracket connected at an end of the respective first and second legs.

6. A fold-up frame for a portable basketball game device, comprising:

a base having a base frame, a front leg structure and a rear leg structure, the base frame having a front side and a rear side, the front leg structure being rotatably coupled to the front side of the base frame, the rear leg structure being rotatably coupled to the rear side of the base frame, each of the front and rear leg structures being moveable between an extended leg position and a storage leg position;

a rear brace frame having a lower brace frame portion and an upper brace frame portion, the lower brace frame portion being rotatably coupled to the rear side of the base frame, the rear brace frame being moveable between a storage rear brace position and an extended rear brace position; and, a backboard brace frame rotatably coupled to the upper brace frame portion, the backboard brace frame having a first brace coupled to a first side of the upper brace frame portion and a second brace coupled to a second side of the upper brace, wherein the rear brace frame includes a pair of opposing rear brace frame sides and a rear brace frame upper side, each of the rear brace frame sides having a top end and a bottom end, the rear brace frame upper side extending between the top ends of the opposing rear brace frame sides.

7. The fold-up frame, as set forth in claim 6, wherein the rear brace frame is rotatably coupled to the base frame by a pair of upper rear hinges.

8. The fold-up frame, as set forth in claim 7, where the upper rear hinges includes a U-shaped bracket connected to a rear side of the base frame.

9. The fold-up frame, as set forth in claim 8, including at least one latch coupled between the base frame and the rear brace frame to controllably maintain the rear brace frame in the extended rear brace position.

10. The fold-up frame, as set forth in claim 1, wherein the backboard brace frame includes a first brace and a second brace, each of the first and second brace including a vertical portion and a horizontal portion.

11. The fold-up frame, as set forth in claim 10, wherein the backboard brace frame is mounted to the rear brace frame by a backboard brace rotational mechanism.

12. The fold-up frame, as set forth in claim 11, wherein each of the first and second braces are rotatable the respective vertical positions between an extended position and a storage position.

13. A fold-up frame for a portable basketball game device, comprising:

a base having a base frame, a front leg structure and a rear leg structure, the base frame having a front side and a rear side, the front leg structure being rotatably coupled to the front side of the base frame, the rear leg structure being rotatably coupled to the rear side of the base frame, each of the front and rear leg structures being moveable between an extended leg position and a storage leg position;

a front leg locking mechanism for locking the front leg structure in the extended position; and, a rear leg locking mechanism for locking the rear leg structure in the extended position;

a rear brace frame having a lower brace frame portion and an upper brace frame portion, the lower brace frame portion being rotatably coupled to the rear side of the base frame, the rear brace frame being moveable between a storage rear brace position and an extended rear brace position, the rear brace frame includes a pair of opposing rear brace frame sides and a rear brace frame upper side, each of the rear brace frame sides having a top end and a bottom end, the rear brace frame upper side extending between the top ends of the opposing rear brace frame sides;

a backboard brace frame rotatably coupled to the upper brace frame portion, the backboard brace frame having a first brace coupled to a first side of the upper brace frame portion and a second brace coupled to a second side of the upper brace, each of the first and second braces including a vertical portion and a horizontal portion, the horizontal portion of the first and second braces configured to extend over the base from when the fold-up frame is assembled, the backboard brace frame including a first brace and a second brace, each of the first and second brace including a vertical portion and a horizontal portion, the backboard brace frame being mounted to the rear brace frame by a backboard brace rotational mechanism, wherein each of the first and second braces are rotatable the respective vertical positions between an extended position and a storage position;

a front frame rotatably coupled to the front side of the base frame and being moveable between a front frame storage front frame position and an extended front frame position;

a ball return ramp coupled to the fold-up frame at a top of the rear brace frame and the front frame; and, a pair of retention sides coupled to opposite ends of the ball return ramp.

14. The fold-up frame, as set forth in claim 13, the front leg structure including a first leg of the front leg structure and a second leg of the front leg structure, the front leg locking mechanism including a front brace associated with at least one of the first leg of the front leg structure and the second leg of the front leg structure, the rear leg structure including a first leg of the rear leg structure and a second leg of the rear leg structure, the rear leg locking mechanism including a rear brace associated with at least one of the first leg of the rear leg structure and the second leg of the rear leg structure.

15. The fold-up frame, as set forth in claim 14, wherein each of the first and second legs of the front leg structure and the rear leg structure is rotatably coupled to the base frame by respective hinges, each hinge including a U-shaped bracket connected at an end of the respective first and second legs.

16. The fold-up frame, as set forth in claim 13, wherein the rear brace frame is rotatably coupled to the base frame by a pair of upper rear hinges.

17. The fold-up frame, as set forth in claim 16, where the upper rear hinges includes a U-shaped bracket connected to a rear side of the base frame.

18. The fold-up frame, as set forth in claim 17, including at least one latch coupled between the base frame and the rear brace frame to controllably maintain the rear brace frame in the extended rear brace position.

19. A portable basketball game, comprising:

a fold-up frame including:

a base having a base frame, a front leg structure and a rear leg structure, the base frame having a front side and a rear side, the front leg structure being rotatably coupled to the front side of the base frame, the rear leg structure being rotatably coupled to the rear side of the base frame, each of the front and rear leg structures being moveable between an extended leg position and a storage leg position;

a rear brace frame having a lower brace frame portion and an upper brace frame portion, the lower brace frame portion being rotatably coupled to the rear side of the base frame, the rear brace frame being moveable between a storage rear brace position and an extended rear brace position; and, a backboard brace frame rotatably coupled to the upper brace frame portion, the backboard brace frame having a first brace coupled to a first side of the upper brace frame portion and a second brace coupled to a second side of the upper brace a front frame rotatably coupled to the front side of the base frame and being moveable between a front frame storage front frame position and an extended front frame position;

a ball return ramp coupled to the fold-up frame at a top of the rear brace frame and the front frame; and, a pair of retention sides coupled to opposite ends of the ball return ramp;

a backboard coupled to the backboard brace frame;

a rim and a net coupled to the backboard;

at least one sensor for detecting a basketball passing through the net; and, a controller connected to the at least one sensor for providing a basketball game.

* * * * *